United States Patent [19]

Woodard et al.

[11] Patent Number: 4,930,744

[45] Date of Patent: Jun. 5, 1990

[54] PROGRAMMED MECHANISM FOR SELECTIVELY LOCATING SWIVEL BRACKET RELATIVE TO TRANSOM BRACKET

[75] Inventors: Robert W. Woodard, Waukegan, Ill.; Eric T. Lucht, Racine; Danny L. Clark, Kenosha, both of Wis.

[73] Assignee: Outboard Marine Corporation, Waukegan, Ill.

[21] Appl. No.: 319,576

[22] Filed: Mar. 6, 1989

[51] Int. Cl.[5] ..... F16M 1/02

[52] U.S. Cl. ..... 248/642; 440/900

[58] Field of Search ..... 248/640, 641, 642, 643; 400/53, 55, 66, 900

[56] References Cited

U.S. PATENT DOCUMENTS

| | | | |
|---|---|---|---|
| 1,831,739 | 11/1931 | Decker . | |
| 2,441,000 | 5/1948 | Armstrong | 248/642 |
| 3,371,893 | 3/1968 | Blanchard, Jr. | 440/63 |
| 3,902,449 | 9/1975 | Berry | 248/642 X |
| 4,239,172 | 12/1980 | Spitzmesser | 248/641 |
| 4,331,430 | 5/1982 | Lutzke et al. | 440/53 |
| 4,402,675 | 9/1983 | Eichinger | 440/53 |
| 4,406,632 | 9/1983 | Blanchard | 248/642 X |
| 4,472,148 | 9/1984 | Kollock et al. | 440/52 |
| 4,482,330 | 11/1984 | Cook | 248/640 X |
| 4,504,237 | 3/1985 | Blanchard | 248/642 X |
| 4,624,438 | 11/1986 | Goodman, Jr. | 248/642 |
| 4,637,800 | 1/1987 | Slattery | 440/63 X |

*Primary Examiner*—Ramon O. Ramirez

*Attorney, Agent, or Firm*—Michael, Best & Friedrich

[57] ABSTRACT

Disclosed herein is a marine propulsion device comprising a propulsion unit adapted to carry a propeller, a swivel bracket pivotally connected to the propulsion unit for relative steering movement therebetween about a steering axis, a link pivotally connected at one end to the swivel bracket about an axis transverse to the steering axis and having a laterally outwardly extending out-turned end, and a transom bracket adapted to be mounted on a transom of a boat, being pivotally connected to the swivel bracket for tilting movement about a tile axis transverse to the steering axis and parallel to the first mentioned transverse axis, and including a surface extending generally in the direction of intended boat travel and having therein a recess receiving and engaging the out-turned end of the link and biasing the link inwardly, which recess includes an endless main portion, a running position branch portion extending downwardly from the endless main portion, and a shallow water drive position branch portion extending downwardly and forwardly from the endless main portion of the recess at a point above the extension of the running position branch portion from the endless main portion of the recess, which endless main position of the recess also includes shoulder means for permitting movement of the link end in the endless main portion of the recess in one direction and preventing movement of the link end in the endless main portion of the recess in the direction opposite the one direction.

12 Claims, 2 Drawing Sheets

PROGRAMMED MECHANISM FOR SELECTIVELY LOCATING SWIVEL BRACKET RELATIVE TO TRANSOM BRACKET

BACKGROUND OF THE INVENTION

The invention relates generally to marine propulsion devices and, more particularly, to outboard motors including a swivel bracket and a connected propulsion unit which tilt in common i.e., which swing in a vertical plane, relative to a transom bracket.

Still more particularly, the invention relates to arrangements for selectively holding the swivel bracket and connected propulsion unit in a raised full-tilt position and in either of a running position (determined by a thrust pin) and a partially raised shallow water drive position.

Attention is directed to the following United States patents:

Decker: 1,831,739
Armstrong: 2,441,000
Blanchard, Jr.: 3,371,893
Lutzke: 4,331,430
Eichinger: 4,402,675
Kollock: 4,472,148
Slattery: 4,637,800

SUMMARY OF THE INVENTION

The invention provides a marine propulsion device comprising a propulsion unit adapted to carry a propeller, a swivel bracket pivotally connected to the propulsion unit for relative steering movement therebetween about a steering axis, a link pivotally connected at one end to the swivel bracket about an axis transverse to the steering axis and having a laterally outwardly extending out-turned end, and a transom bracket adapted to be mounted on a transom of a boat, being pivotally connected to the swivel bracket for tilting movement about a tilt axis transverse to the steering axis and parallel to the first mentioned transverse axis, and including a surface extending generally in the direction of intended boat travel and having therein a recess receiving and engaging the out-turned end of the link and biasing the link inwardly, which recess includes an endless main portion, a running position branch portion extending downwardly from the endless main portion, and a shallow water drive position branch portion extending downwardly and forwardly from the endless main portion of the recess at a point above the extension of the running position branch portion from the endless main portion of the recess, which endless main position of the recess also includes shoulder means for permitting movement of the link end in the endless main portion of the recess in one direction and preventing movement of the link end in the endless main portion of the recess in the direction opposite the one direction.

The invention also provides a transom bracket adapted to be mounted on a boat transom and adapted to be pivotally connected to a swivel bracket for tilting movement thereof about a horizontal tilt axis, which transom bracket includes a surface extending generally in the direction of intended boat travel and having therein a recess adapted to receive and engage an out-turned end of a swivel bracket supporting link, and adapted to bias the link for movement toward the recess, which recess comprises an endless main portion including shoulder means for permitting movement of the link end in the endless main portion of the recess in one direction and preventing movement of the link end in the endless main portion of the recess in the direction opposite the one direction.

The invention also provides a transom bracket adapted to be mounted on a boat transom, and adapted to be pivotally connected to a swivel bracket for relative tilting movement therebetween, which transom bracket includes a surface extending generally in the direction of intended boat travel and having therein a recess adapted to receive and engage the out-turned end of a link carried by the swivel bracket, which recess includes an endless main portion, a running position branch portion extending downwardly from the endless main portion, and a shallow water drive position branch portion extending downwardly and forwardly from the endless main portion of the recess at a point above the extension of the running position branch portion from the endless main portion of the recess, which endless main portion of the recess also includes shoulder means for permitting movement of the link end in the endless main portion of the recess in one direction and preventing movement of the link end in the endless main portion of the recess in the direction opposite the one direction.

The invention also provides a bracket assembly adapted to support a main propulsion unit, which bracket assembly comprises a swivel bracket adapted to be pivotally connected to the propulsion unit for relative steering movement therebetween about a steering axis, a link pivotally connected at one end to the swivel bracket about an axis transverse to the steering axis and having a laterally outwardly extending out-turned end, and a transom bracket adapted to be mounted on a transom of a boat, being pivotally connected to the swivel bracket for tilting movement about a tilt axis transverse to the steering axis and parallel to the first mentioned transverse axis, and including a surface extending generally in the direction of intended boat travel and having therein a recess receiving and engaging the out-turned end of the link and biasing the link inwardly, which recess includes an endless main portion, a running position branch portion extending downwardly from the endless main portion, and a shallow water drive position branch portion extending downwardly and forwardly from the endless main portion of the recess at a point above the extension of the running position branch portion from the endless main portion of the recess, which endless main position of the recess also includes shoulder means for permitting movement of the link end in the endless main portion of the recess in one direction and preventing movement of the link end in the endless main portion of the recess in the direction opposite the one direction.

In one embodiment of the invention, the endless main portion of the recess includes a vertical sub-portion extending generally vertically and having a lower end and an upper end, an upper sub-portion extending forwardly and downwardly from the upper end of the vertical sub-portion and including an outer end, a connecting sub-portion including an entry part extending upwardly and rearwardly from the outer end of the upper sub-portion and including an upper end located above the upper end of the vertical sub-portion and a return part extending downwardly from the upper end of the entry part in rearwardly spaced relation to the vertical sub-portion, which return part includes an exit segment extending to the lower end of the vertical sub-portion, and the shoulder means includes a first stop permitting link movement from the vertical sub-portion to the shallow water drive branch portion and preventing link movement from the shallow water drive branch portion to the vertical sub-portion below the first stop, a second stop permitting link movement from the vertical sub-portion to the upper sub-portion and preventing link movement from the upper sub-portion to the vertical sub-portion, a third stop for permitting link movement from the upper sub-portion to the entry part of the connecting sub-portion and preventing link movement from the entry part of the connecting sub-portion to the upper sub-portion, a fourth stop for permitting link movement from the entry part of the connecting sub-portion to the return part of the connecting sub-portion and preventing link movement from the return part of the connecting sub-portion to the entry part, and a fifth stop permitting link movement from the exit segment of the return part to the lower end of the vertical sub-portion and preventing link movement from the lower end of the vertical sub-portion to the exit segment of the return part of the connecting sub-portion.

In one embodiment of the invention, the vertical sub-portion includes a first part extending between the lower end and the first stop and having a bottom wall spaced from the surface at a first distance, which vertical sub-portion also includes a second part located above the first stop and having a bottom wall spaced from the surface at a second distance greater than the first distance, which vertical sub-portion further includes an upper part located adjacent to the upper end and having a bottom wall spaced from the surface at a third distance less than the second distance, which vertical sub-portion includes an intermediate part located between the upper and second parts and having a bottom wall spaced from the surface at a distance which gradually diminishes from the second distance to the third distance. In addition, the upper sub-portion has a bottom wall spaced from the surface at a fourth distance greater than the third distance, and the entry part of the connecting sub-portion includes a lower segment having a bottom wall spaced from the surface at a fifth distance greater than the fourth distance. Still further in addition, the entry part of the connecting sub-portion includes an upper segment having a bottom wall spaced from the surface at a sixth distance less than the fifth distance, and the entry part of the connecting sub-portion includes an intermediate segment located between the upper and lower segments and having a bottom wall spaced from the surface at a distance which gradually diminishes from the fifth distance to the sixth distance. In addition, the return part of the connecting sub-portion includes an upper segment extending from the upper segment of the entry part and having a bottom wall spaced from the surface at a seventh distance greater than the sixth surface, which return part of the connecting sub-portion includes an exit segment extending from the lower end of the vertical sub-portion and having a bottom wall spaced from the surface at an eighth distance less than the first distance, and which return part of the connecting sub-portion includes an intermediate segment extending between the upper segment and the exit segment and having a bottom wall spaced from the surface at a distance which gradually diminishes from the seventh distance to the eighth distance.

Other features and advantages of the invention will become apparent to those skilled in the art upon review of the following detained description, claims and drawings.

THE DRAWINGS

Figure 1:
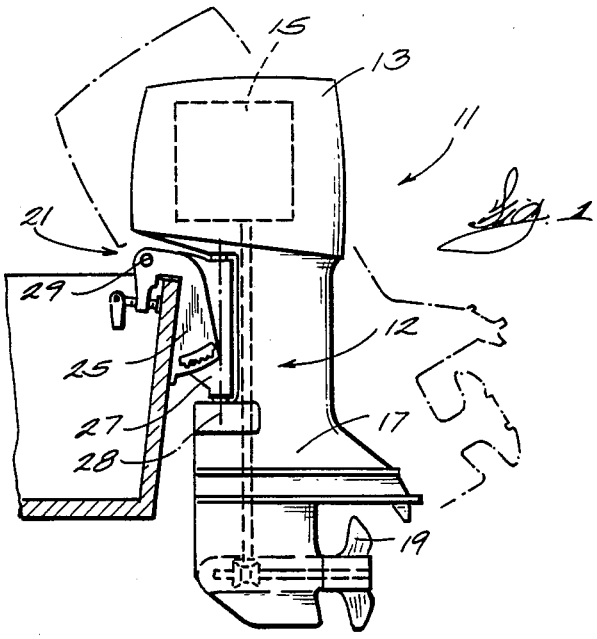
FIG. 1 is a side elevational view, partially in section of an outboard motor installation emboding various of the features of the invention.

Before one embodiment of the invention is explained in detail, it is to be understood that the invention is not limited in its application to the details of the construction and the arrangements of components set forth in the following description or illustrated in the drawings. The invention is capable other embodiments and of being practiced or being carried out in various ways. Also, it is to be understood that the phraseology and terminology used herein is for the purpose of description and should not be regarded as limiting.

GENERAL DESCRIPTION

Shown in the drawings is a marine propulsion device in the form of an outboard motor 11 including a propulsion unit 12 comprising a power head 13 including an engine 15 and a lower unit 17 extending from the power head 13 and including a propeller 19 driven by the engine 15.

The propulsion unit 12 is pivotally connected to a bracket assembly 21 adapted to be removably fixed to the transom 23 of a boat. More particularly, the bracket assembly 21 includes a transom bracket 25 adapted to be fixed to the boat transom 23, and a swivel bracket 27 connected to the transom bracket 25 by suitable means affording tilting movement of the swivel bracket 27 relative to the transom bracket 25 and about a horizontal tilt axis 29. In turn, the swivel bracket 27 is connected to the propulsion unit 12 for common tilting movement about the tilt axis 29 and for steering movement of the propulsion unit 12 relative to the swivel bracket 27 about an axis 28 transverse to the tilt axis 29. This general construction is well known in the art.

In practice, the transom bracket 25 conventionally includes (See FIG. 2) a pair of spaced rearward extending wings or portions 31 and 33 which project rearwardly from the boat transom 23 and between which the swivel bracket 27 is partially received. The wing portions 31 and 33 conventionally and respectively include inside surfaces 35 and 37 which are in spaced relation and which face each other.

Means are provided for releasably holding the swivel bracket 27 in a full-tilt position, in a lower running position, and in an intermediate or shallow water drive position and for facilitating one way travel or movement of the swivel bracket between these positions in a repetitive orbital path.

More particularly, while other constructions can be employed, in the disclosed construction, such means comprises, in the inside surfaces 35 and 37, respective recesses 45 and 47, and, on the swivel bracket 27, a pair of links 51 and 53 which, at one end, are mounted for pivotal movement relative to the swivel bracket 27 about a common axis 55 which is parallel to the tilt axis 29. The links 51 and 53 also include remote portions with respective out-turned ends 57 and 59 adapted to be respectively received in the recesses 45 and 47 in the transom bracket wing portions 31 and 33. While other constructions can be employed in the disclosed construction, the links 51 and 53 form portions of a one-piece U-shaped member 61 which is fabricated of resilient material and which includes a connecting part 63 which joins the links 51 and 53, which is coincidental with the axis 55 and which is fixed to the swivel bracket 27 for pivotal movement relative thereto by one or more brackets or clamps 65.

Means are provided for biasing the out-turned ends 57 and 59 into engagement with the bottoms of the recesses 45 and 47. While other construction could be employed, in the disclosed construction, such means includes the resilient characteristics of the member 61 and the formation of the U-shaped member 61 such that, when the member 61 is in relaxed condition, the out-turned ends 57 and 59 are spaced from each other at a distance greater than the spacing of bottoms of the recesses 45 and 47 from each other. As a consequence, the out-turned ends 57 and 59 are self-biasing against the bottoms of the recesses 45 and 47 when the out-turned ends 57 and 59 are assembled or located in the recesses 45 and 47.

In this last regard, the recesses 45 and 47 are generally of identical construction and each includes a pair of spaced side walls 71 and 72 and a bottom wall 73 and each comprises an endless main portion 74 including a generally vertical sub-portion 75 which can have a slight upward and rearward inclination, and which include an upper end 77, a lower end 79, and a middle part 81. The recesses 45 and 47 also each include an upper sub-portion 85 extending downwardly and forwardly from the upper end 77 of the vertical sub-portion 75 and having an outer end 87 which, when the out-turned ends 57 and 59 of the links 51 and 53 are located therein, defines the full-tilt position of the swivel bracket 27 and connected propulsion unit 12.

The recesses 45 and 47 also each include a lower or shallow water drive position branch portion 91 which projects forwardly and downwardly from the middle part 81 of the main sub-portion 75 and which includes an outer end 93 defining the shallow water drive position of the swivel bracket 27 and connected propulsion unit 12 when the out-turned ends 57 and 59 of the links 51 and 53 are located therein.

The endless main portion 74 of each of the recesses 45 and 47 also includes a connecting or loop sub-portion 97 including a first or entry part 99 extending upwardly and rearwardly from the outer end 87 of the upper sub-portion 85 to an uppermost end 101 located in spaced relation above the upper end 77 of the vertical sub-portion 75. In addition, the connecting sub-portion 97 includes a return part 103 which extends vertically and in rearwardly spaced relation to the vertical sub-portion 75 and between the uppermost end 101 of the entry part 99 of the connecting sub-portion 97 and the lower end 79 of the vertical sub-portion 75. The lower end of the return part 103 of the connecting sub-portion 97 constitute an exit segment 105.

The recesses 45 and 47 also each include a running position branch portion 111 which extends downwardly from the lower end 79 of the vertical sub-portion 75 and constitutes an extension thereof.

Means are provided for insuring one way travel of the out-turned ends 57 and 59 of the links 51 and 53 in the endless main portion 74 of the recesses 45 and 47 in response to operator actuated manipulation of the swivel bracket 27 and connected propulsion unit 12.

While other constructions can be employed, in the disclosed construction, such means comprises a series of shoulders, stops, or detents in the floor or bottom of each of the endless main portions 74 of the recesses 45 and 47.

Figure 2:
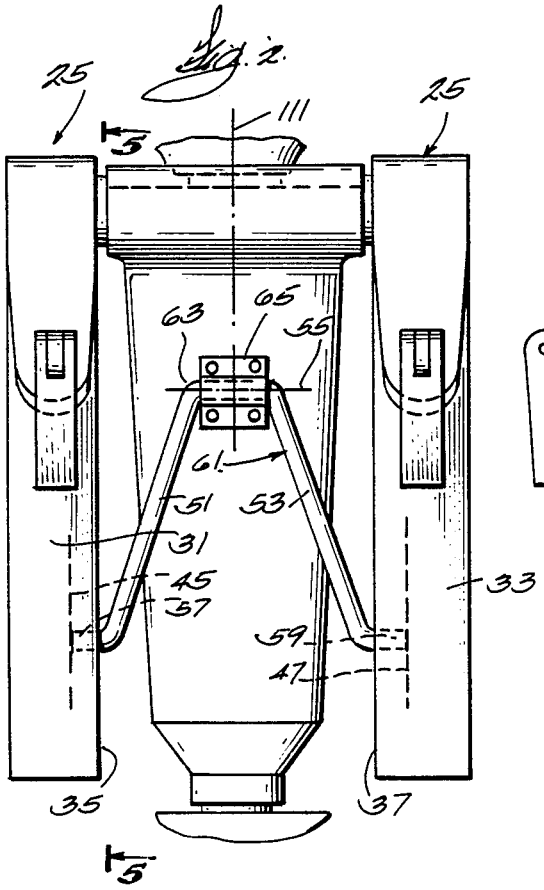
FIG. 2 is a fragmentary and enlarged front view (with the boat transom omitted) of the outboard motor shown in FIG. 1.
Figure 3:
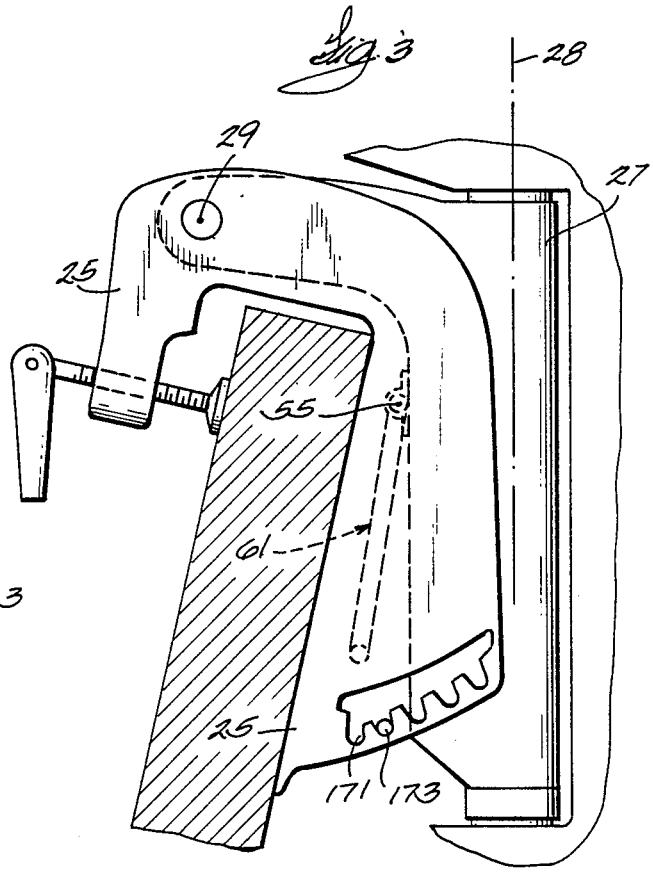
FIG. 3 is an enlarged fragmentary side elevational view of a portion of the outboard motor shown in FIG. 1 and illustrating the outboard motor in a running position.
Figure 6:
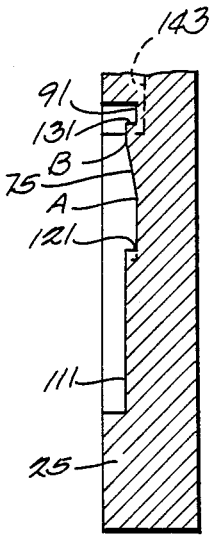
FIG. 6 is a fragmentary view, in section, taken along line 6—6 of FIG. 4.
Figure 7:
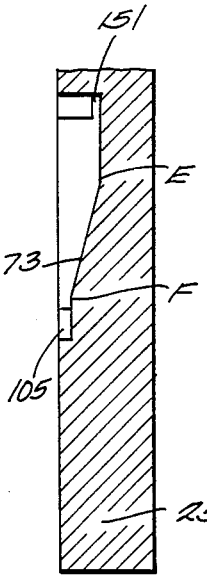
FIG. 7 is a fragmentary view, in section, taken along line 7—7 of FIG. 4.
Figure 4:
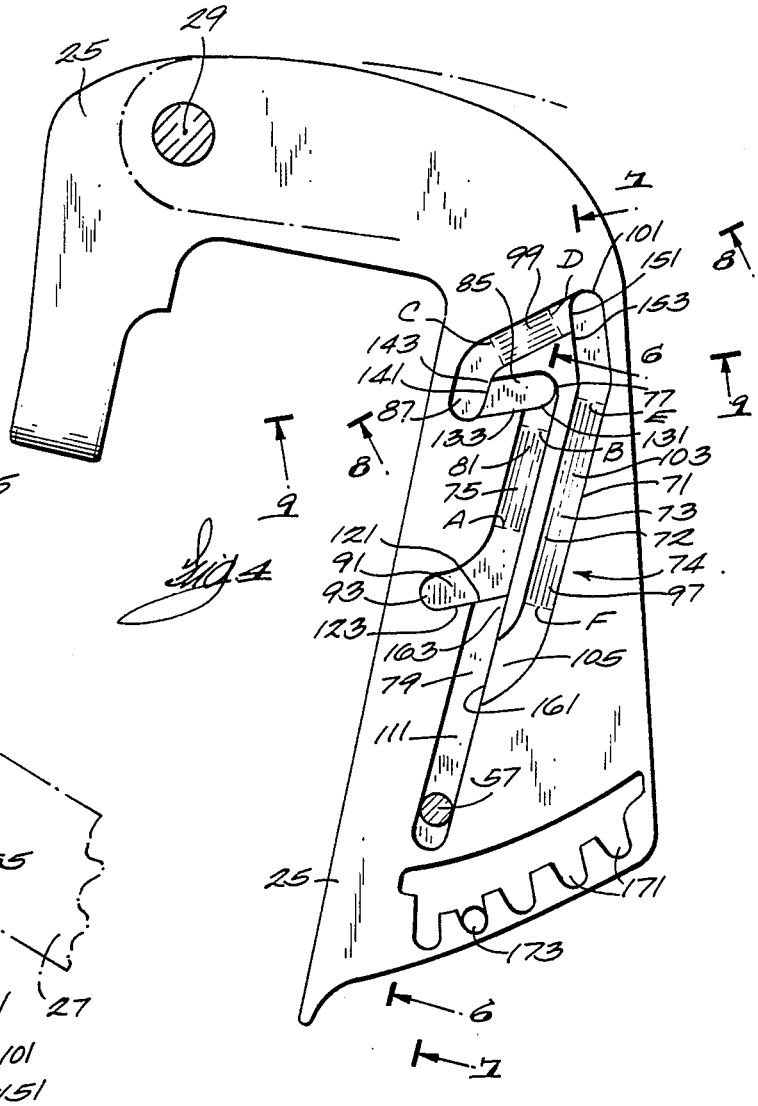
FIG. 4 is a view similar to FIG. 3, taken along line 5—5 of FIG. 2, and with parts omitted, and showing the inside construction of the transom bracket.
Figure 5:
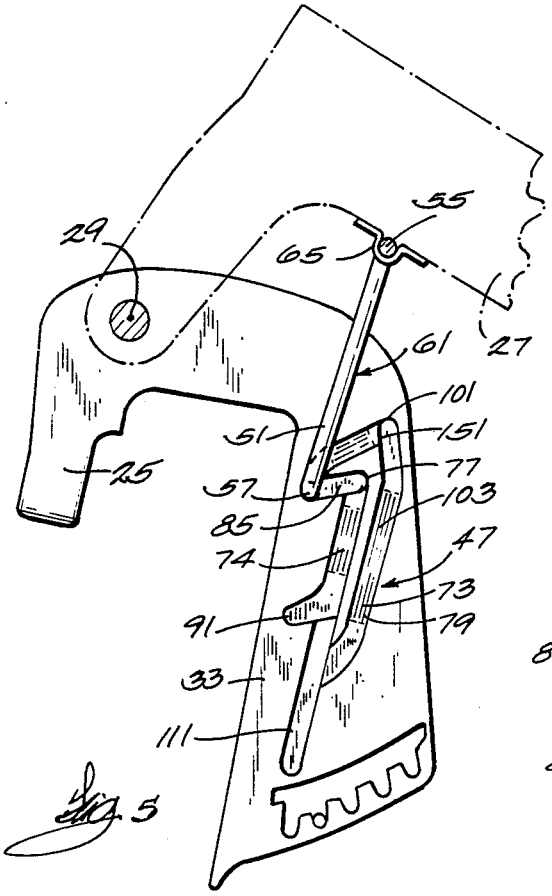
FIG. 5 is an enlarged fragmentary side elevational view similar to FIG. 3 and illustrating the outboard motor in a full-tilt position.
Figure 9:
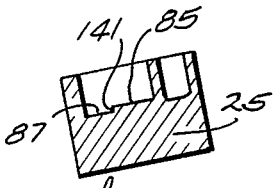
FIG. 9 is a fragmentary view, in section, taken along line 9—9 of FIG. 4.
Figure 8:
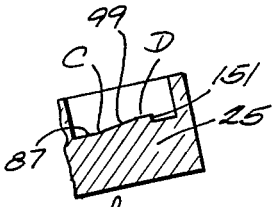
FIG. 8 is a fragmentary view, in section, taken along line 8—8 of FIG. 4.

More specifically, as already pointed out, each of the recesses 45 and 47 includes a pair of side walls 71 and 72 extending from a floor or bottom wall 73 which is located at a pre-selected distance from the inside surfaces 35 and 37 of the transom bracket wing portions 31 and 33 or from an imaginary vertical plane indicated at 111 in FIG. 2.

Still more specifically, the endless main portions 74 of each of the recesses 45 and 47 include a first stop or shoulder 121 located in the bottom wall 73, and in registry with the bottom side wall 123 of the lower or shallow water drive position branch portion 91 and is defined by a first abrupt increase in the depth of the bottom wall 73 from the adjacent one of the inside surfaces 35 and 37 or from the vertical plane 111. Accordingly, when the swivel bracket 27 is raised to locate the out-turned ends 57 and 59 above the first stop 121, the outward bias of the link ends 57 and 59 will cause the link ends 57 and 59 to outwardly move and engage the bottom wall 75 above the stop 121 to prevent downward movement of the links below the stop 121, while affording movement of the outward ends 57 and 59 to the outer ends 87 of the shallow water drive branch position 85, i.e., to the shallow water drive position. Thus when the out-turned ends 57 and 59 are located above the stop 121, the swivel bracket 27 and connected propulsion unit 12 can be manipulated to permit downward movement of the out-turned ends 57 and 59 into the lower or shallow water drive position branch portion 91 to the outer end 93 thereof to locate the propulsion unit 12 in the shallow water drive position. Alternately, the swivel bracket 27 and connected propulsion unit 12 can be upwardly manipulated to move the out-turned ends 57 and 59 further upwardly in the vertical sub-portion 75 of the recesses 45 and 47.

From the point "A" to the point "B", the depth of the recess i.e., the distance of the bottom wall 73 from the adjacent one of the inside surface 35 and 37 or from the vertical plane 111 is gradually diminished so that the depth of the recesses 45 and 47 at point "B" is generally the same as below the first stop 121 and so that the out-turned ends 57 and 59 of the links 51 and 53 are, again, biased more strongly outwardly.

The endless main portions 74 of each of the recesses 45 and 47 are also each provided with a second stop or shoulder 131 extending in general alignment with the lower side wall 133 of the upper sub-portion 85. This stop 131 is provided by abruptly increasing the depth of the recesses 45 and 47 so that, when the out-turned ends 57 and 59 travel past the second stop 131, downward or return movement in the vertical sub-portion 75 is prevented. As a consequence, the propulsion unit 12 and connected swivel bracket 27 can thereafter be slightly lowered to rest at the outer end 87 of the upper sub-portion 85 in the full-tilt position.

When it is desired to return the swivel bracket 27 and connected propulsion unit 12 to the lower or running position, or to the shallow water drive position, the swivel bracket 27 and connected propulsion unit 12 can be manipulated by raising the swivel bracket 27 and connected propulsion unit 12 to cause entry of the out-turned ends 57 and 59 into entry part 99 the connecting sub-portion of the recesses 45 and 47. In this regard, the outer end 87 of the upper sub-portion 85 is provided with a third stop 141 which is in alignment with the rearward side wall 143 of the entry part 99 of the connecting sub-portion 97 and which is defined by an additional abrupt increase in recess depth or distance of the bottom wall 73 from the adjacent one of the inside surfaces 35 and 37 or from the vertical plane 111.

The lower end of the entry part 99 of the connecting sub-portion 97 extends upwardly and rearwardly at this depth until point "C". Thereafter, the recess depth is gradually diminished to a depth (at the point "D") which is about the same as the recess depth immediately above the first stop 121. The bottom wall 73 then extends at this depth to adjacent the uppermost end 101 of the entry part 99 which connects with an upper end segment 149 of the return part 103. In this regard, and in order to prevent return or downward movement from the uppermost end 101 in the entry part 99 of the connecting sub-portion 97, the recesses 45 and 47 are each provided with a fourth stop or shoulder 151 extending in registry with the forward side wall 153 of the upper end segment 149 of the return part 103 of the connecting sub-portion 97. The fourth stop 151 is defined by another abrupt increase in the recess depth to about the same depth as the recess depth at the outer end 87 of the upper sub-portion 85.

The upper segment 149 extends downwardly at the same depth to about the point "E" after which the recess depth again gradually diminishes to the point "F" thereby again increasing the biasing on the out-turned ends 57 and 59 of the links 51 and 53 toward the recess bottom walls 74, to a depth less than the depth of the vertical sub-portion 75 below the first stop 121.

Finally, the return part 103 of the connecting sub-portion 97 includes the lower or terminal or exit segment 105 which extends at the last mentioned depth and which connects with the lower end 79 of the vertical sub-portion 75.

Because the depth of the middle part 81 of the vertical sub-portion 75 below the lower or shallow water drive position branch portion 91 is greater than the recess depth in the lower or exit segment 105 of the return part 103, a fifth stop or shoulder 161 is defined or provided at the rearward side wall 163 at the lower end 79 of the vertical sub-portion 75, which fifth stop or shoulder 161 prevents movement of the out-turned ends 57 and 59 of the links 51 and 53 from the lower end 79 of the vertical sub-portion 75 to the exit or lower segment 105 of the return part 103 of the connecting sub-portion 97. Above the fifth stop 161 in the vertical sub-portion 75 and below the fifth stop 161 in the running position branch portion 111, the recesses 45 and 47 have a generally constant predetermined depth and the turned-out ends 57 and 59 of the links 51 and 53 can move upwardly and downwardly therein as desired.

Accordingly, because of the stops or detents 121, 131, 141, 151 and 161, the links 51 and 53 extending from the swivel bracket 27 and connected propulsion unit 12 can travel or orbit in only one direction in the endless main portion 74 of the recesses 45 and 47 i.e., in the clockwise direction as shown in the drawings.

As is customary, each of the wing portions 31 and 33 of the transom bracket 25 also include a series of thrust pin recesses 171 adapted to selectively receive a thrust pin 173 and thereby to limit downward swinging movement of the propulsion unit 12 to establish the running position. Thus, depending upon the location of the thrust pin 173 in the thrust pin recesses 171, the running position can be located anywhere between the junction of the exit segment 105 of the return part 103 of the connecting sub-portion 97 with the lower end 79 of the vertical sub-portion 75 and the lower end of the running position branch portion 111.

Various of the features of the invention are set forth in the following claims.

We claim:

1. A marine propulsion device comprising a propulsion unit adapted to carry a propeller, a swivel bracket pivotally connected to said propulsion unit for relative steering movement therebetween about a steering axis, a link pivotally connected at one end to said swivel bracket about an axis transverse to said steering axis and having a laterally outwardly extending out-turned end, and a transom bracket adapted to be mounted on a transom of a boat, being pivotally connected to said swivel bracket for tilting movement about a tilt axis transverse to said steering axis and parallel to said first mentioned transverse axis, and including a surface extending generally in the direction of intended boat travel and having therein a recess receiving and engaging said out-turned end of said link and biasing said link inwardly, said recess including an endless main portion, a running position branch portion extending downwardly from said endless main portion, and a shallow water drive position branch portion extending downwardly and forwardly from said endless main portion of said recess at a point above the extension of said running position branch portion from said endless main portion of said recess, said endless main portion of said recess also including shoulder means for permitting movement of said link end in said endless main portion of said recess in one direction and preventing movement of said link end in said endless main portion of said recess in the direction opposite said one direction.

2. A marine propulsion device in accordance with claim 1 wherein said endless main portion of said recess includes a vertical sub-portion extending generally vertically and having a lower end and an upper end, an upper sub-portion extending forwardly and downwardly from said upper end of said vertical sub-portion and including an outer and, a connecting sub-portion including an entry part extending upwardly and rearwardly from said outer end of said upper sub-portion and including an upper end located above said upper end of said vertical sub-portion and a return part extending downwardly from said upper end of said entry part in rearwardly spaced relation to said vertical sub-portion, said return part including an exit segment extending to said lower end of said vertical sub-portion, and wherein said shoulder means includes a first stop permitting link movement from said vertical sub-portion to said shallow water drive position branch portion and preventing link movement from said shallow water drive position branch portion to said vertical sub-portion below said first stop, a second stop permitting link movement from said vertical sub-portion to said upper sub-portion and preventing link movement from said upper sub-portion to said vertical sub-portion, a third stop for permitting link movement from said upper sub-portion to said entry part of said connecting sub-portion and preventing link movement from said entry part of said connecting sub-portion to said upper sub-portion, a fourth stop for permitting link movement from said entry part of said connecting sub-portion to said return part of said connecting sub-portion and preventing link movement from said return part of said connecting sub-portion to said entry part, and a fifth stop permitting link movement from said exit segment of said return part to said lower end of said vertical sub-portion and preventing link movement from said lower end of said vertical sub-portion to said exit segment of said return part of said connecting sub-portion.

3. A marine propulsion device in accordance with claim 2, wherein said vertical sub-portion includes a first part extending between said lower end and said first stop and having a bottom wall spaced from said surface at a first distance, wherein said vertical sub-portion includes a second part located above said first stop and having a bottom wall spaced from said surface at a second distance greater than said first distance, wherein said vertical sub-portion includes an upper part located adjacent to said upper end and having a bottom wall spaced from said surface at a third distance less than said second distance, wherein said vertical sub-portion includes an intermediate part located between said upper and second parts and having a bottom wall spaced from said surface at a distance which gradually diminishes from said second distance to said third distance, wherein said upper sub-portion has a bottom wall spaced from said surface at a fourth distance greater than said third distance, wherein said entry part of said connecting sub-portion includes a lower segment having a bottom wall spaced from said surface at a fifth distance greater than said fourth distance, wherein said entry part of said connecting sub-portion includes an upper segment having a bottom wall spaced from said surface at a sixth distance less than said fifth distance, wherein said entry part of said connecting sub-portion includes an intermediate segment located between said upper and lower segments and having a bottom wall spaced from said surface at a distance which gradually diminishes from said fifth distance to said sixth distance, wherein said return part of said connecting sub-portion includes an upper segment extending from said upper segment of said entry part and having a bottom wall spaced from said surface at a seventh distance greater than said sixth surface, wherein said return part of said connecting sub-portion includes an exit segment extending from said lower end of said vertical sub-portion and having a bottom wall spaced from said surface at an eighth distance less than said first distance, and wherein said return part of said connecting sub-portion includes an intermediate segment extending between said upper segment and said exit segment and having a bottom wall spaced from said surface at a distance which gradually diminishes from said seventh distance to said eight distance.

4. A marine propulsion device comprising a transom bracket adapted to be mounted on a transom of a boat and including a surface extending generally in the direction of intended boat travel and a recess located in said surface, including a bottom wall, and comprising an endless main portion including a vertical sub-portion extending generally vertically and having a lower end, and an upper end, an upper sub-portion extending forwardly and downwardly from said upper end of said vertical sub-portion and including an outer end, and a connecting sub-portion including an entry part extending upwardly and rearwardly from said outer end of said upper sub-portion and including an upper end located above said upper end of said vertical sub-portion and a return part extending downwardly from said upper end of said entry part in rearwardly spaced relation to said vertical sub-portion, said return part including an exit segment extending to said lower end of said vertical sub-portion, a shallow water drive position branch portion extending forwardly and downwardly from above said lower end of said vertical sub-portion, and a running position branch portion extending downwardly from said lower end of said vertical sub-portion, a swivel bracket pivotally connected to said transom bracket for tilting movement relative thereto about a tilt axis, a link pivotally connected at one end to said swivel bracket about an axis parallel to said tilt axis and having an outer end engaged in said recess, said outer end being biased toward said bottom wall of said recess, and said endless main portion of said recess also including first stop means permitting link movement from said vertical sub-portion to said shallow water drive position branch portion and preventing movement from said shallow water drive position branch portion to said vertical sub-portion below said first stop, second stop means permitting link movement from said vertical sub-portion to said upper sub-portion and preventing movement from upper sub-portion to said vertical sub-portion, third stop means for permitting link movement from said upper sub-portion to said entry part of said connecting sub-portion and preventing link movement from said entry part of said connecting sub-portion to said upper sub-portion, fourth stop means for permitting link movement from said entry part of said connecting sub-portion to said return part of said connecting sub-portion and preventing link movement from said return part of said connecting sub-portion to said entry part of said connecting sub-portion, and fifth stop mean permitting link movement from said exit segment of said return part of said connecting sub-portion to said vertical sub-portion and preventing link movement from said vertical sub-portion to said exit segment of said return part of said connecting sub-portion, and a propulsion unit connected to said swivel bracket for tilting movement in common with said swivel bracket and for pivotal steering movement relative to said swivel bracket, said propulsion unit being adapted to support a propeller.

5. A marine propulsion device in accordance with claim 4, wherein said vertical sub-portion includes a first part extending between said lower end and said first stop and having a bottom wall spaced from said surface at a first distance, wherein said vertical sub-portion includes a second part located above said first stop and having a bottom wall spaced from said surface at a second distance greater than said first distance, wherein said vertical sub-portion includes an upper part located adjacent to said upper end and having a bottom wall spaced from said surface at a third distance less than said second distance, wherein said vertical sub-portion includes an intermediate part located between said upper and second parts and having a bottom wall spaced from said surface at a distance which gradually diminishes from said second distance to said third distance, wherein said upper sub-portion has a bottom wall spaced from said surface at a fourth distance greater than said third distance, wherein said entry part of said connecting sub-portion includes a lower segment having a bottom wall spaced from said surface at a fifth distance greater than said fourth distance, wherein said entry part of said connecting sub-portion includes an upper segment having a bottom wall spaced from said surface at a sixth distance less than said fifth distance, wherein said entry part of said connecting sub-portion includes an intermediate segment located between said upper and lower segments and having a bottom wall spaced from said surface at a distance which gradually diminishes from said fifth distance to said sixth distance, wherein said return part of said connecting sub-portion includes an upper segment extending from said upper segment of said entry part of said connecting sub-portion and having a bottom wall spaced from said surface at a seventh distance greater than said sixth surface, wherein said return part of said connecting sub-portion includes an exit segment extending from said lower end of said vertical sub-portion and having a bottom wall spaced from said surface at an eighth distance less than said first distance, and wherein said return part of said connecting sub-portion includes an intermediate segment extending between said upper segment and said exit segment and having a bottom wall spaced from said surface at a distance which gradually diminishes from said seventh distance to said eight distance.

6. A transom bracket adapted to be mounted on a boat transom and adapted to be pivotally connected to a swivel bracket for tilting movement thereof about a horizontal tilt axis, said transom bracket including a surface extending generally in the direction of intended boat travel and having therein a recess adapted to receive and engage an out-turned end of a swivel bracket supporting link, and adapted to bias the link for movement toward said recess, said recess comprising an endless main portion including shoulder means for permitting orbital movement of the link end in said endless main portion of said recess in one direction and preventing orbital movement of the link end in said endless main portion of said recess in the direction opposite said one direction.

7. A transom bracket adapted to be mounted on a boat transom and being adapted to be pivotally connected to a swivel bracket for relative tilting movement therebetween, said transom bracket having therein a recess adapted for receiving and engaging the out-turned end of a link carried by the swivel bracket, said recess including an endless main portion, a running position branch portion extending downwardly from said endless main portion, and a shallow water drive position branch portion extending downwardly and forwardly from said endless main portion of said recess at a point above the extension of said running position branch portion from said endless main portion of said recess, said endless main portion of said recess also including shoulder means for permitting movement of the link end in said endless main portion of said recess in one direction and preventing movement of the link end in said endless main portion of said recess in the direction opposite said one direction.

8. A transom bracket in accordance with claim 7 wherein said endless main portion of said recess includes a vertical sub-portion extending generally vertically and having a lower end and an upper end, an upper sub-portion extending forwardly and downwardly from said upper end of said vertical sub-portion and including an outer end, a connecting sub-portion including an entry part extending upwardly and rearwardly from said outer end of said upper sub-portion and including an upper end located above said upper end of said vertical sub-portion and a return part extending downwardly from said upper end of said entry part in rearwardly spaced relation to said vertical sub-portion, said return part including an exit segment extending to said lower end of said vertical sub-portion, and wherein said shoulder means includes a first stop permitting link movement from said vertical sub-portion to said shallow water drive position branch portion and preventing link movement from said shallow water drive position branch portion to said vertical sub-portion below said first stop, a second stop permitting link movement from said vertical sub-portion to said upper sub-portion and preventing link movement from said upper sub-portion to said vertical sub-portion, a third stop for permitting link movement from said upper sub-portion to said entry part of said connecting sub-portion and preventing link movement from said entry part of said connecting sub-portion to said upper sub-portion, a fourth stop for permitting link movement from said entry part of said connecting sub-portion to said return part of said connecting sub-portion and preventing link movement from said return part of said connecting sub-portion to said entry part, and a fifth stop permitting link movement from said exit segment of said return part to said lower end of said vertical sub-portion and preventing link movement from said lower end of said vertical sub-portion to said exit segment of said return part of said connecting sub-portion.

9. A transom bracket in accordance with claim 8, wherein said vertical sub-portion includes a first part extending between said lower end and said first stop and having a bottom wall spaced from said surface at a first distance, wherein said vertical sub-portion includes a second part located above said first stop and having a bottom wall spaced from said surface at a second distance greater than said first distance, wherein said vertical sub-portion includes an upper part located adjacent to said upper end and having a bottom wall spaced from said surface at a third distance less than said second distance, wherein said vertical sub-portion includes an intermediate part located between said upper and second parts and having a bottom wall spaced from said surface at a distance which gradually diminishes from said second distance to said third distance, wherein said upper sub-portion has a bottom wall spaced from said surface at a fourth distance greater than said third distance, wherein said entry part of said connecting sub-portion includes a lower segment having a bottom wall spaced from said surface at a fifth distance greater than said fourth distance, wherein said entry part of said connecting sub-portion includes an upper segment having a bottom wall spaced from said surface at a sixth distance less than said fifth distance, wherein said entry part of said connecting sub-portion includes an intermediate segment located between said upper and lower segments and having a bottom wall spaced from said surface at a distance which gradually diminishes from said fifth distance to said sixth distance, wherein said return part of said connecting sub-portion includes an upper segment extending from said upper segment of said entry part and having a bottom wall spaced from said surface at a seventh distance greater than said sixth surface, wherein said return part of said connecting sub-portion includes an exit segment extending from said lower end of said vertical sub-portion and having a bottom wall spaced from said surface at an eighth distance less than said first distance, and wherein said return part of said connecting sub-portion includes an intermediate segment extending between said upper segment and said exit segment and having a bottom wall spaced from said surface at a distance which gradually diminishes from said seventh distance to said eight distance.

10. A bracket assembly adapted to support a marine propulsion unit, said bracket assembly comprising a swivel bracket adapted to be pivotally connected to the propulsion unit for relative steering movement therebetween about a steering axis, a link pivotally connected at one end to said swivel bracket about an axis transverse to said steering axis and having a laterally outwardly extending out-turned end, and a transom bracket adapted to be mounted on a transom of a boat, being pivotally connected to said swivel bracket for tilting movement about a tilt axis transverse to said steering axis and parallel to said first mentioned transverse axis, and including a surface extending generally in the direction of intended boat travel and having therein a recess receiving and engaging said out-turned end of said link and biasing said link inwardly, said recess including an endless main portion, a running position branch portion extending downwardly from said endless main portion, and a shallow water drive position branch portion extending downwardly and forwardly from said endless main portion of said recess at a point above the extension of said running position branch portion from said endless main portion of said recess, said endless main portion of said recess also including shoulder means for permitting movement of said link end in endless main portion of said recess in one direction and preventing movement of said link end in said endless main portion of said recess in the direction opposite said one direction.

11. A bracket assembly in accordance with claim 10 wherein said endless main portion of said recess includes a vertical sub-portion extending generally vertically and having a lower end and an upper end, an upper sub-portion extending forwardly and downwardly from said upper end of said vertical sub-portion and including an outer end, a connecting sub-portion including an entry part extending upwardly and rearwardly from said outer end of said upper sub-portion and including an upper end located above said upper end of said vertical sub-portion and a return part extending downwardly from said upper end of said entry part in rearwardly spaced relation to said vertical sub-portion, said return part including an exit segment extending to said lower end of said vertical sub-portion, and wherein said shoulder means includes a first stop permitting link movement from said vertical sub-portion to said shallow water drive position branch portion and preventing link movement from said shallow water drive position branch portion to said vertical sub-portion below said first stop, a second stop permitting link movement from said vertical sub-portion to said upper sub-portion and preventing link movement from said upper sub-portion to said vertical sub-portion, a third stop for permitting link movement from said upper sub-portion to said entry part of said connecting sub-portion and preventing link movement from said entry part of said connecting sub-portion to said upper sub-portion, a fourth stop for permitting link movement from said entry part of said connecting sub-portion to said return part of said connecting sub-portion and preventing link movement from said return part of said connecting sub-portion to said entry part, and a fifth stop permitting link movement from said exit segment of said return part to said lower end of said vertical sub-portion and preventing link movement from said lower end of said vertical sub-portion to said exit segment of said return part of said connecting sub-portion.

12. A bracket assembly in accordance with claim 11, wherein said vertical sub-portion includes a first part extending between said lower end and said first stop and having a bottom wall spaced from said surface at a first distance, wherein said vertical sub-portion includes a second part located above said first stop and having a bottom wall spaced from said surface at a second distance greater than said first distance, wherein said vertical sub-portion includes an upper part located adjacent to said upper end and having a bottom wall spaced from said surface at a third distance less than said second distance, wherein said vertical sub-portion includes an intermediate part located between said upper and second parts and having a bottom wall spaced from said surface at a distance which gradually diminishes from said second distance to said third distance, wherein said upper sub-portion has a bottom wall spaced from said surface at a fourth distance greater than said third distance, wherein said entry part of said connecting sub-portion includes a lower segment having a bottom wall spaced from said surface at a fifth distance greater than said fourth distance, wherein said entry part of said connecting sub-portion includes an upper segment having a bottom wall spaced from said surface at a sixth distance less than said fifth distance, wherein said entry part of said connecting sub-portion includes an intermediate segment located between said upper and lower segments and having a bottom wall spaced from said surface at a distance which gradually diminishes from said fifth distance to said sixth distance, wherein said return part of said connecting sub-portion includes an upper segment extending from said upper segment of said entry part and having a bottom wall spaced from said surface at a seventh distance greater than said sixth surface, wherein said return part of said connecting sub-portion includes an exit segment extending from said lower end of said vertical sub-portion and having a bottom wall spaced from said surface at an eighth distance less than said first distance, and wherein said return part of said connecting sub-portion includes an intermediate segment extending between said upper segment and said exit segment and having a bottom wall spaced from said surface at a distance which gradually diminishes from said seventh distance to said eight distance.

* * * * *